US005526618A

United States Patent [19]

Thomas

[11] Patent Number: 5,526,618

[45] Date of Patent: Jun. 18, 1996

[54] CASED-ARCHED OPENING KIT AND METHOD OF INSTALLATION

[76] Inventor: John S. Thomas, 2410 Everett Ave., Raleigh, N.C. 27607

[21] Appl. No.: 38,652

[22] Filed: Mar. 29, 1993

[51] Int. Cl.[6] ..... F06B 1/04

[52] U.S. Cl. ..... 52/211; 52/86; 52/213; 52/745.07; 52/DIG. 1

[58] Field of Search ..... 52/85, 86, 210, 52/211, 212, 213, 127.2, 586, 204.2, 456, 745.2, 745.07, DIG. 1; 33/563, 403, 419, 566, 567

[56] References Cited

U.S. PATENT DOCUMENTS

| | | | |
|---|---|---|---|
| 317,072 | 5/1885 | Ackerson | 52/DIG. 1 X |
| 924,877 | 6/1909 | Banfill | 33/566 |
| 1,983,516 | 12/1934 | Ahola | 33/419 |
| 2,064,704 | 12/1936 | Vass | 52/213 |
| 4,233,741 | 11/1980 | Bisset | 33/403 |
| 4,400,917 | 8/1983 | Massaro et al. | 52/86 |
| 4,601,138 | 7/1986 | Hampton | 52/211 |
| 4,719,729 | 1/1988 | Wynar | 52/212 |
| 4,955,168 | 9/1990 | Barry | 52/86 |
| 5,113,590 | 5/1992 | Shapiro et al. | 33/403 |

FOREIGN PATENT DOCUMENTS

| | | | |
|---|---|---|---|
| 4007055 | 6/1991 | Germany | 52/204.2 |

*Primary Examiner*—Carl D. Friedman
*Assistant Examiner*—Winnie S. Yip
*Attorney, Agent, or Firm*—Rhodes, Coats & Bennett

[57] ABSTRACT

The present invention entails a kit of components for constructing a cased-arched opening and also involves a method of installing the components of the kit. The kit comprises a pair of side columns with each column being generally U-shaped and designed to be inserted around a terminal edge of a wall that borders an open passageway. Further, the kit includes a curved arched assembly that is opened at the top and includes a void that permits the arched assembly to be sandwiched around a lower terminal edge portion of an upper wall section that surrounds the passageway. The respective columns are designed to fit under and support the curved arched assembly and all of the components can be nailed or otherwise secured to the structure to form a cased-arched opening.

11 Claims, 4 Drawing Sheets

CASED-ARCHED OPENING KIT AND METHOD OF INSTALLATION

FIELD OF THE INVENTION

The present invention relates to residential construction kits and particularly to a kit of components designed to form a cased archway.

BACKGROUND OF THE INVENTION

Cased openings are very popular today in residential construction. They impart an airy open appearance to the interior of a residential structure and also suggest a relatively high level of detail and craftsmanship for that particular home. This is especially true with cased-arched openings which are becoming increasingly popular in traditional, transitional and contemporary homes alike.

However, there is a major problem with cased-arched openings today. For the most part, they are built on-site and are entirely custom-built for each house. It is very time-consuming to "stick" or custom build such cased-arched openings. But more importantly, it is difficult to find interior trim carpenters who have the skill or craftsmanship to "stick" or custom-build a cased-arched opening. This is true even though there is a great demand for skilled interior trim carpenters.

Therefore, there is a need for a cased-arched opening kit that can be quickly and efficiently installed and which can be done by interior trim carpenters having less than a high degree of skill.

SUMMARY AND OBJECTS OF THE INVENTION

The present invention entails a cased-arched opening kit that can be quickly and efficiently installed by trim carpenters that possess less than a high degree of skill and ability. Basically, the cased opening kit of the present invention includes a pair of generally C-shaped columns with each column being adapted to be inserted around the terminal edge of a side wall that defines or borders an opening or passageway through the structure. Further, the kit includes an upper curved archway assembly that is designed to be sandwiched around the upper wall board that overlies the opening or passageway in the structure. The curved arched assembly is supported by the pair of erected columns and all three components are secured to the wall structure surrounding the passageway.

It is therefore an object of the present invention to provide a cased-arched opening kit that is easy to install and which can be installed by a trim carpenter having a low to medium level of skill.

A further object of the present invention resides in the provision of a cased-arched opening kit of the character referred to above that is particularly designed to be used in conjunction with an existing opening or passageway within the structure.

A further object of the present invention is to provide a method for installing a cased-arched opening kit of the present invention that is simple and direct.

Another object of the present invention resides in the provision of a cased-arched opening kit of the character referred to above that has the appearance of being a custom-made cased-arched opening when installed.

It is also an object of the present invention to provide a design for a cased-arched opening kit that makes the kit suitable for passageways of various sizes including passageways or openings having various depths.

Still a further object of the present invention resides in the provision of a method for forming a cased-arched opening in an existing passageway wherein the method includes a simple and direct procedure for forming an arch in a wall board section overlying the passageway.

Other objects and advantages of the present invention will become apparent and obvious from a study of the following description and the accompanying drawings which are merely illustrative of such invention.

DETAILED DESCRIPTION OF THE INVENTION

Figure 1:
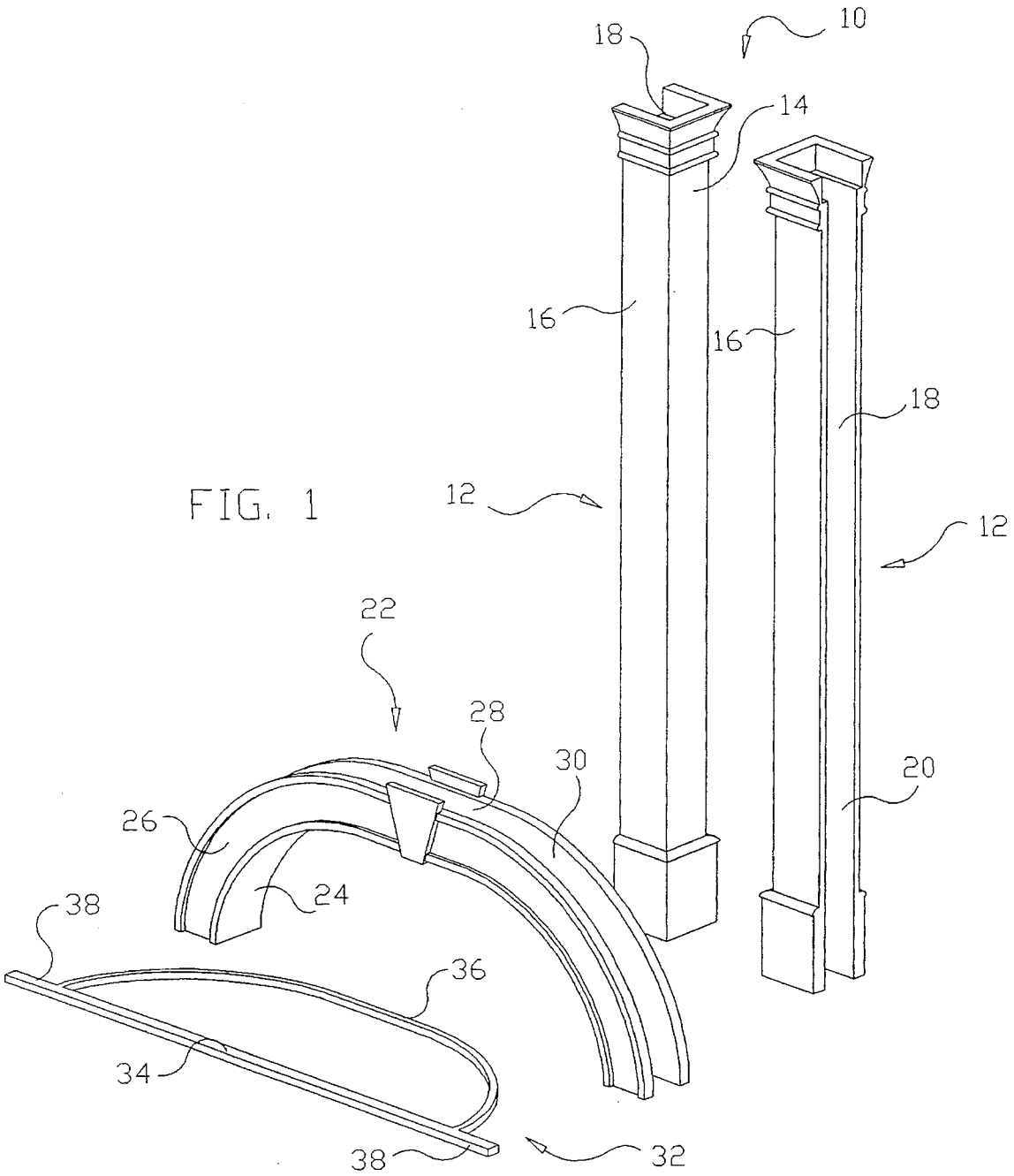
FIG. 1 is a perspective view of the individual components of the cased-arced opening kit of the present invention.

With further reference to the drawings, the cased-arched opening kit of the present invention is shown therein and indicated generally by the numeral 10. Viewing the components of the kit as illustrated in FIG. 1, it is seen that the kit includes a pair of side columns, each column being indicated generally by the numeral 12. Each column 12 includes a face 14, a pair of sides 16, an open fourth side 20 and as seen in the drawings a void 18 is defined within the face 14 and the pair of sides 16. As will be more fully appreciated from subsequent portions of this disclosure, the design of the column 12 enables the same to be inserted into and along the edge of a standing wall. It is appreciated that each column 12 assumes a generally C-shape due to the construction of face 14 and sides 16.

Also forming a part of the kit is a curved arch assembly indicated generally by the numeral 22. Curved arch assembly 22 includes a curved base 24 and a pair of laterally spaced sides 26. The curved arch assembly 22 includes an open top 28 and there is defined between the curved base 24 and sides 26 a voided area 30.

Finally forming a part of the kit 10 of the present invention is a template indicated generally by the numeral 32. Template 32 includes a base 34, an arch guide 36 and a pair of extensions 38 that extend outwardly from the base 34 past the arch guide 36. As will be appreciated from subsequent portions of this disclosure, template 32 is used to shape the upper wall structure overlying a passageway into the shape of an arch.

Figure 2:
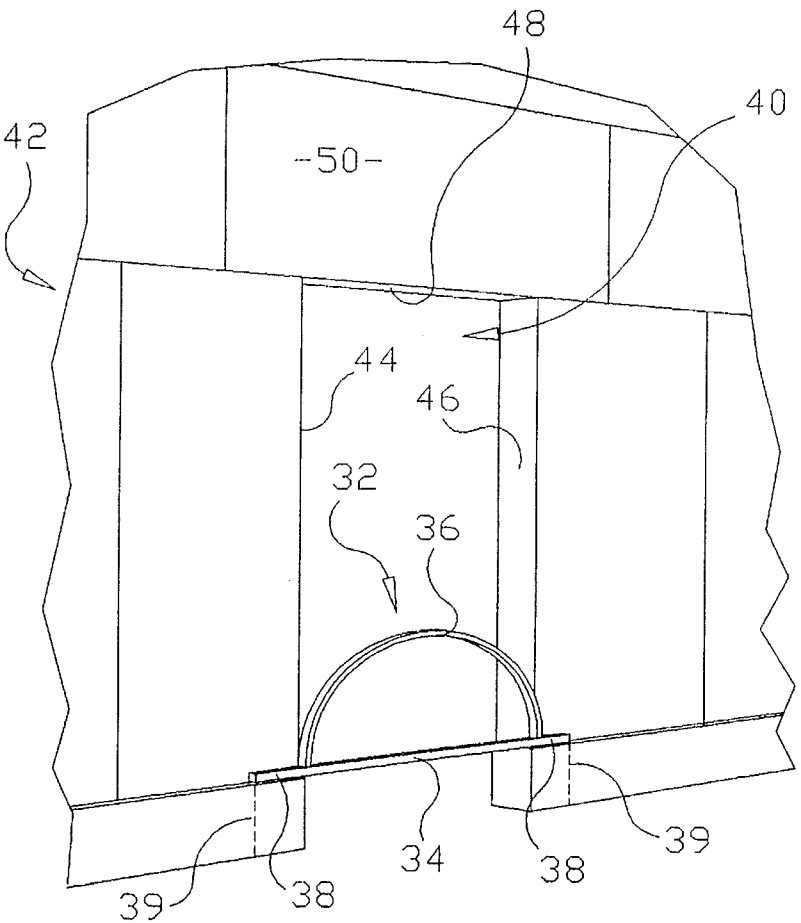
FIG. 2 is perspective view of the template of the kit of the present invention illustrating its use in measuring the baseboard adjacent an opening or passageway in the wall structure.

With further reference to the drawings, it will be beneficial to briefly review the structure of a wall and passageway so as to better appreciate how the cased-arched opening kit 10 is installed into such a wall structure. In this regard, and with particular reference to FIG. 2, there is seen therein a passageway or opening indicated generally by the numeral 40. Surrounding and extending from the passageway 40 is a wall structure indicated generally by the numeral 42. Wall structure 42 includes a side wall edge 44 and 46 that extends along opposite sides of the passageway or opening 40. Extending over the passageway 40 is an upper wall edge 48 and an upper wall portion 50. In typical situations, the wall structure 42 will be comprised of internal studs having a wall board such as sheet rock secured thereto. In the drawings the wall structure 42 is of the new construction type. Bit it will be appreciated that the kit 10 of the present invention can be used in old construction to convert an opening or passageway to a cased-arched opening.

Figure 3:
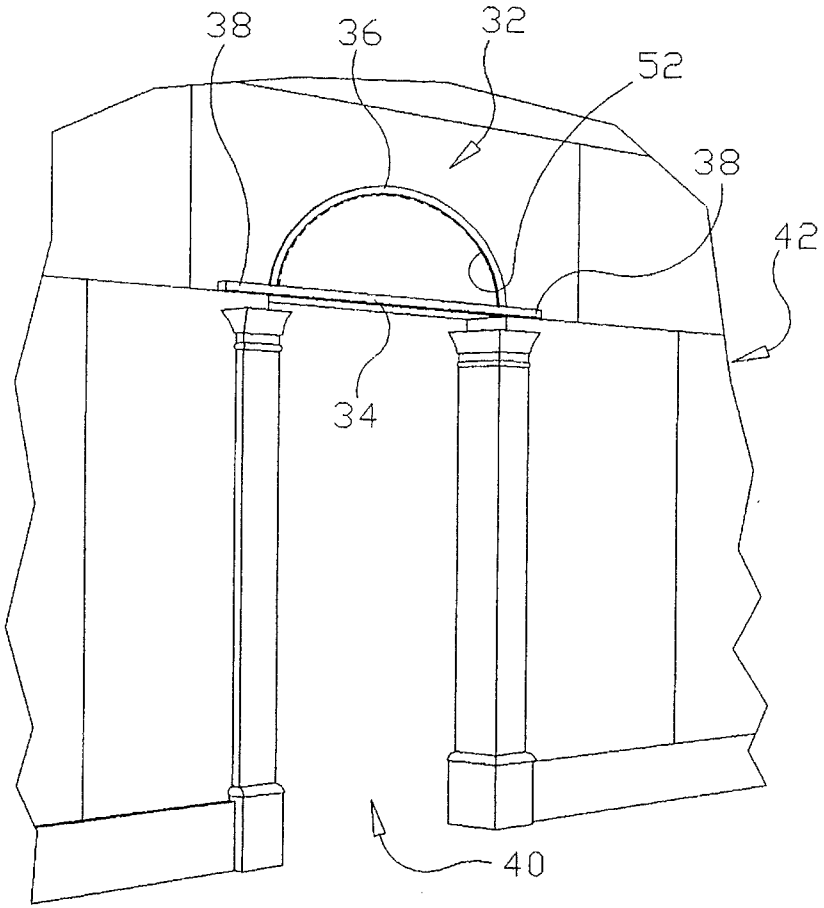
FIG. 3 is a perspective view illustrating the template of the kit used to inscribe an arch cutting line over a passageway.
Figure 4:
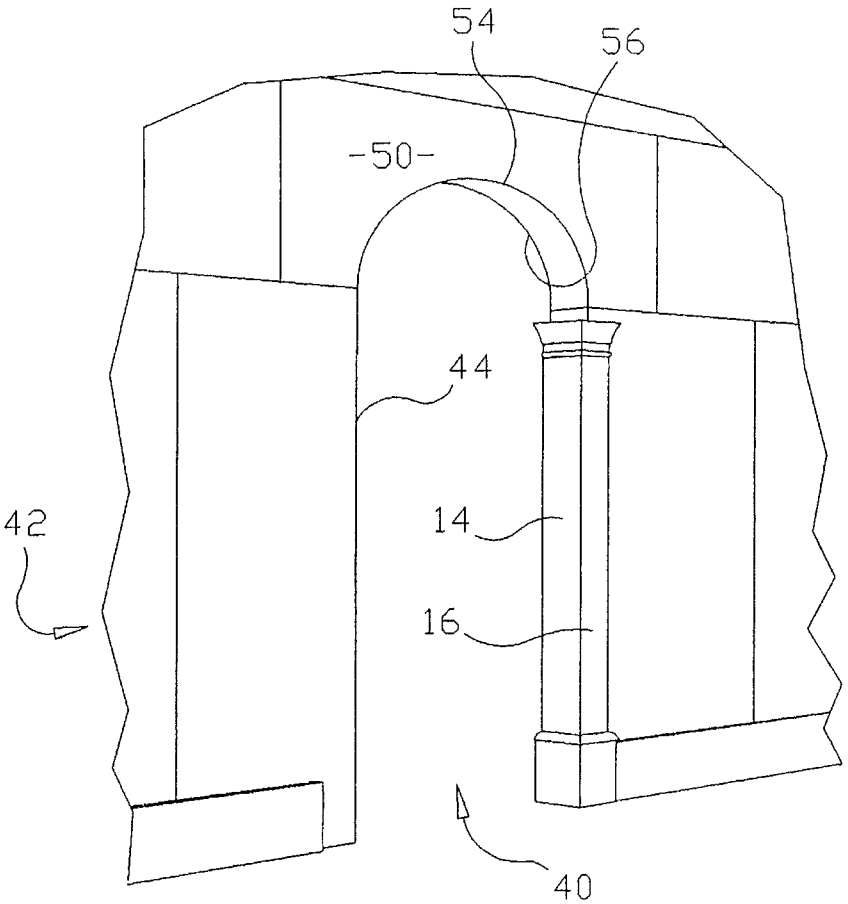

In the case of new construction the wall board 50 would be secured to a stud wall in such a fashion that the overhead header would be spaced upwardly above the upper wall edge 48. The template 32 would be positioned adjacent the wall board as shown in FIG. 3 and an arch line 52 would be inscribed on the wall board 50 by utilizing the arch guide 36. This can be accomplished by utilizing a pencil or some other type of marking pen. Once the template is removed from the upper wall portion 50, it is seen that there is a dotted inscribed arched line 52 that is formed on the wall board. Thereafter, the upper wall portion 50 is cut along the inscribed line 52. It should be pointed out that the wall board is cut on both sides of the passageway or opening 40 so as to form two arched cut edges 54 and 56 as shown in FIG. 4. Thus, the passageway 40 now includes an upper arch cut-out opening.

In making the arch cut-out just described, it is beneficial and appropriate to first install each of the columns 12 along a respective side wall edge 44 and 46. See FIG. 3. This simply entails installing each column 12 by inserting respective side wall edge 44 or 46 into the void formed in the respective columns 12. Next, the template 32 is placed on the top of the columns 12 as illustrated in FIG. 3 and the inscribed arch line 52 is drawn on the upper wall portion 50 by utilizing the arch guide 36 of the template. Once the inscribed arch line 52 has been made, the columns 12 are removed and the upper wall portion 50 is cut to form the arch cut edges 54 and 56.

Now to install the kit 10 of the present invention, a first column 12 is installed on one of the side wall edges 44 or 46. (FIG. 4) In particular, the column 12 is placed in the passageway with the open side 20 facing a respective side wall edge. The column 12 is then slipped over the side wall edge 44 or 46 such that it essentially surrounds on the three sides the respective side wall edge, This column is vertically leveled. See FIG. 4.

Figure 5:
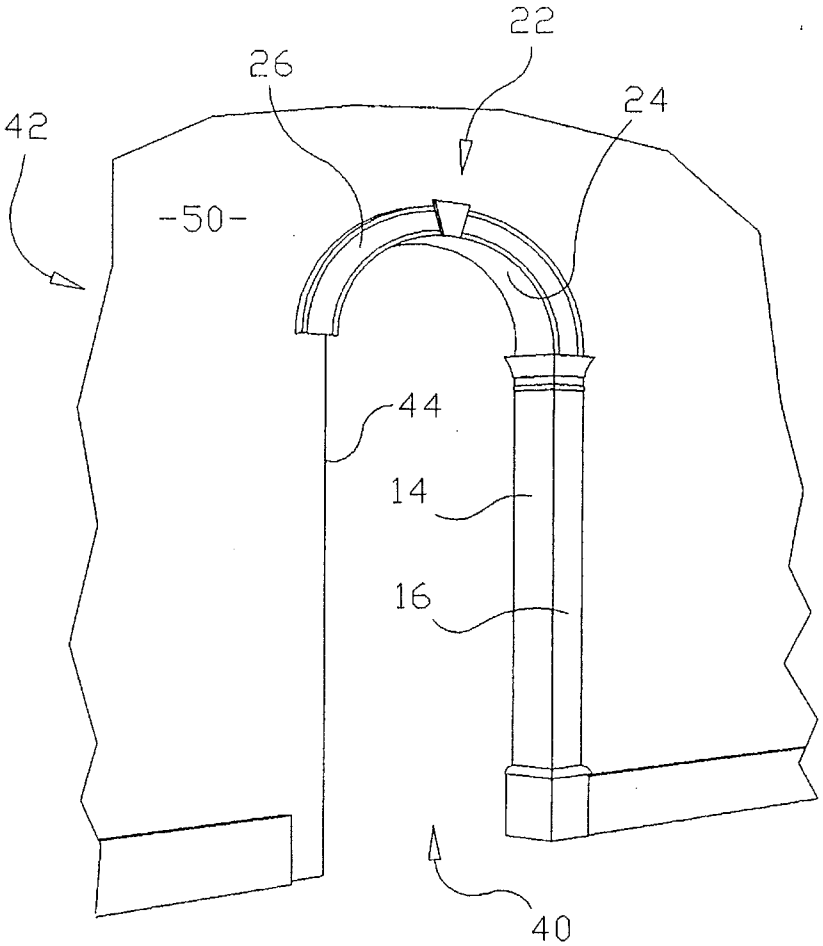
FIGS. 4–7 are a sequence of views illustrating the installation of the cased-arched kit of the present invention.

Next, the curved arched assembly or arch header 22 is installed. One side of the curved arched assembly is supported on the top by the first installed column 12 and the curved arched header 22 is pushed upwardly to where the sides 26 generally sandwich the upper wall portion 50 just above the cut arch lines 54 and 56. See FIG. 5. At this point, the curved arched header 22 is supported only on one side by the first column 12 installed.

Now, the second column 12 is installed in the same manner as the first column. That is, the second column is placed in the passageway with its open side 20 facing the other side wall edge. Now the column is moved towards the side wall edge and the column is slipped over the side wall edge such that three sides of the columns, that is the face 14 and its two sides 16, surround the column. Now, the other end of the curved arched header 22 can be supported by the second column 12.

It should be pointed out that once the first column was installed along the side wall edge that the same was vertically leveled such that it stood plumb. By the same token, the second column 12 when installed, is also vertically leveled such that it stands erect and plumb.

Figure 7:
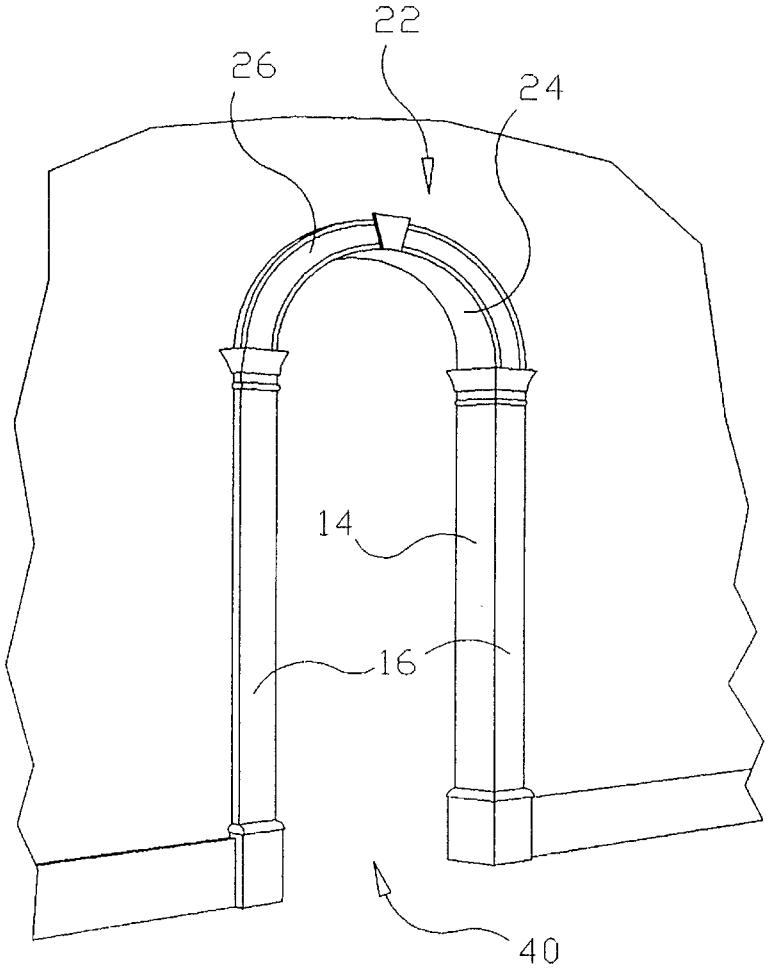
Figure 6:
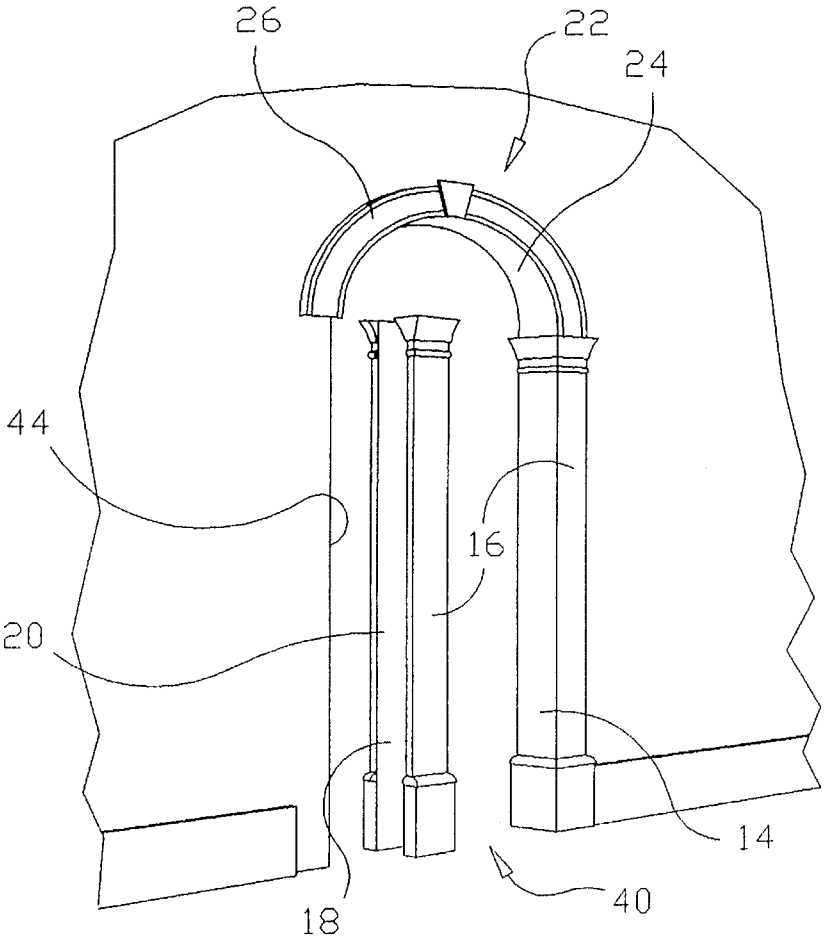

Once the two columns 12 and the curved arched header 22 have been appropriately placed around the wall structure as shown in FIG. 7, the respective pieces of the kit are then nailed and secured to each other and the surrounding wall structure so as to anchor the entire kit around the passageway 40 so as to form a finished cased-arched opening.

It should also be noted that the cased-arched opening kit 10 of the present invention can be utilized in existing construction to convert a rectangular passageway or cased opening into an arched cased opening.

In this regard, the first step is to remove existing casing from the opening. Thus, all surrounding wood and molding are removed from the passageway or cased opening.

Next, the method entails mounting opposing wall boards in the top of the passageway. This is done by nailing blocks in the upper corners of the passageway and then attaching a pair of opposed sheet rock or wall board panels to the block. Now, it is appreciated that one has two spaced-apart sheet rock panels depending downwardly from the header of the original opening. Next, the columns 12 are placed around the existing side wall edge 44 or 46 and the template 32 is rested on the columns and by using the arch guide 36 of the template 32 an arch line 52 is inscribed on at least one of the wall board panels installed in the top of the passageway opening. Thereafter, the columns 12 are removed and the installed sheet rock or wall board panels are cut along the inscribed line to form a pair of cut arch lines such as 54 and 56.

It is also important when dealing with existing construction to remove a short length of baseboard adjacent the passageway 40 such that the lower portion of the columns 12 will fit neatly against the wall and join the baseboard. To accomplish this, the template 32 is designed such that the extensions 38 that extend from the template 32 a preselected distance that corresponds to the length of baseboard that should be cut from the lower area adjacent the passageway 40. Note in FIG. 2 that the template can be placed adjacent the lower portion of existing passageway 40 and the baseboard can be marked (see marked lines 39 in FIG. 2) along the terminal ends of the extensions 38 and accordingly, the baseboard can be cut at these points and removed. This enables the columns 12 to fit flush against the cut baseboard when they are appropriately installed.

From the foregoing specification and discussion, it is seen that the present invention entails an efficient and effective kit for forming a passageway, either an existing passageway or a new construction passageway, into a cased-arched opening. The kit is designed such that a high level of skill is not required and is also designed such that the components of the kit can be quickly and easily installed. Also, once installed, the cased-arched opening kit of the present invention has the appearance of a neat highly crafted opening.

The present invention may, of course, be carried out in other specific ways than those herein set forth without parting from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A kit for installing a cased-arched opening within a passageway extending through a wall having first and second side wall sections and an overhead wall section, the cased-arched opening kit comprising:

a) a template for inscribing an arched cut line about the overhead wall section and including an arched guide that is designed to be positioned adjacent the overhead wall section after which a cut line can be inscribed across the overhead wall section by utilizing the guide arch as a guide for forming the cut line;

b) a curved generally arcuate-shaped arched section having an open upper side for permitting the arch section to be sandwiched around the overhead wall section after the overhead wall section has been cut along the inscribed cut line;

c) a first column having an open side for permitting the first column to be sandwiched around the first side wall section disposed adjacent the passageway;

d) a second column having an open side wall for permitting the second column to be sandwiched around the second side wall section adjacent the passageway; and e) wherein the arched section includes opposed ends that connect to and rest on the top portion of the two columns.

2. The kit according to claim 1 wherein the template includes a horizontal base and wherein the arched guide extends over the horizontal base.

3. The kit according to claim 2 wherein the template is of an open construction and includes an open area between the arched guide and the horizontal base.

4. The kit of claim 2 wherein the base of the template includes at least one baseboard measuring extension that enables one to mark a baseboard at an appropriate point for cutting such that a portion of the baseboard adjacent the passageway can be cut and removed such that the cased opening can be easily and conveniently installed in the passageway.

5. The kit according to claim 1 wherein the arched section includes a curved base and a pair of laterally spaced curved sides and wherein the curved base and curved sides form an open trough therebetween for sandwiching the overhead wall section.

6. The kit according to claim 5 wherein each column includes a base and a pair of spaced apart sides and wherein the base and spaced apart sides define an elongated void that is adapted to receive a respective side wall section formed adjacent the passageway.

7. A kit for installing a cased-arched opening within a passageway extending through a wall having first and second side wall sections adjacent the passageway and an overhead wall section above the passageway, the kit comprising:

a) a first column having a face, a pair of laterally spaced sides, and an open side for permitting the first column to be sandwiched around the first side wall section adjacent the passageway;

b) a second column having a face, a pair of laterally spaced sides, and an open side for permitting the second column to be sandwiched around the second side wall section adjacent the passageway;

c) an upper, curved arch assembly having a curved base, laterally spaced sides, and an open top for permitting the curved arch assembly to be sandwiched around the overhead wall section above the passageway, the curved arch assembly also having opposed ends that rest atop the columns in a finished cased-arched opening; and d) a template for inscribing an arched cut line about the overhead wall section above the passageway.

8. The kit of claim 7 wherein the curved base and the laterally spaced sides of the curved arch assembly define a voided area adapted to receive the overhead wall section above the passageway in the finished cased-arched opening.

9. The kit of claim 7 wherein the face and the laterally spaced sides of each column define an elongated void adapted to receive a respective side wall section adjacent the passageway in the finished cased-arched opening.

10. The kit of claim 7 wherein the laterally spaced sides of the curved arch assembly have arcuate top edges.

11. The kit of claim 7 wherein the laterally spaced sides of the curved arch assembly comprise curved molding pieces.

* * * * *